US011529029B2

(12) United States Patent
Wicker et al.

(10) Patent No.: US 11,529,029 B2
(45) Date of Patent: Dec. 20, 2022

(54) SUPPORT SPINDLE ASSEMBLY FOR A ROLL

(71) Applicant: Essity Hygiene and Health Aktiebolag, Gothenburg (SE)

(72) Inventors: Nathan J. Wicker, Chicago, IL (US); Scott J. Rote, Chicago, IL (US); David A. Wylen, Chicago, IL (US); Matthew P. Kramp, Neenah, WI (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 133 days.

(21) Appl. No.: 16/973,838

(22) PCT Filed: Jun. 12, 2018

(86) PCT No.: PCT/EP2018/065540

§ 371 (c)(1),
(2) Date: Dec. 10, 2020

(87) PCT Pub. No.: WO2019/238222

PCT Pub. Date: Dec. 19, 2019

(65) Prior Publication Data

US 2021/0121026 A1 Apr. 29, 2021

(51) Int. Cl.
*A47K 10/40* (2006.01)
*A47K 10/38* (2006.01)
(Continued)

(52) U.S. Cl.
CPC ..... *A47K 10/405* (2013.01); *A47K 10/3836* (2013.01); *B65H 75/185* (2013.01);
(Continued)

(58) Field of Classification Search
None
See application file for complete search history.

(56) References Cited

U.S. PATENT DOCUMENTS 3,672,591 A * 6/1972 Davis ..... A47K 10/3836 242/597.5
3,788,573 A * 1/1974 Thomson ..... A47K 10/3836 242/410
(Continued)

FOREIGN PATENT DOCUMENTS

CN 1320024 A 10/2001
CN 104244788 A 12/2014
(Continued)

OTHER PUBLICATIONS

The Federal Service for Intellectual Property, Office Action, Application No. 2020142308/03(078600), dated Apr. 28, 2021 (13 pages).
(Continued)

*Primary Examiner* — William A. Rivera
(74) *Attorney, Agent, or Firm* — Cantor Colburn LLP

(57) ABSTRACT

A support spindle assembly for rotatably supporting a coreless paper roll for dispensing, the support spindle assembly including a spindle base, a spindle element having a central longitudinal axis (X) and having first and second ends, the spindle element being attached to the spindle base at the first end and rotationally fixed in relation to the spindle base and a rotatable sleeve rotatably disposed about the spindle element, and rotatable in relation to the spindle base and to the spindle element. The support spindle assembly includes a resilient member disposed about the first end of the spindle element, which resilient member is arranged to cooperate with the spindle base and with the rotatable sleeve in order to provide the rotatable sleeve with a rotational resistance.

15 Claims, 7 Drawing Sheets

(51) Int. Cl.

| | |
|---|---|
| ***B65H 75/18*** | (2006.01) |
| ***B65H 75/30*** | (2006.01) |
| ***A47K 10/32*** | (2006.01) |

(52) U.S. Cl.
CPC ..... *B65H 75/30* (2013.01); *A47K 2010/3206* (2013.01); *A47K 2010/3253* (2013.01); *B65H 2301/41369* (2013.01); *B65H 2402/60* (2013.01); *B65H 2403/725* (2013.01)

(56) References Cited

U.S. PATENT DOCUMENTS

| | | | | |
|---|---|---|---|---|
| 3,963,188 | A * | 6/1976 | DiVeto | A47K 10/3836 242/597.5 |
| 5,310,129 | A | 5/1994 | Whittington et al. | |
| 5,323,980 | A | 6/1994 | Neveu et al. | |
| 5,445,345 | A | 8/1995 | Neveu et al. | |
| 5,727,751 | A | 3/1998 | Liu | |
| 7,014,140 | B2 * | 3/2006 | Elliott | A47K 10/3687 242/559.2 |
| 10,765,273 | B1 * | 9/2020 | Work | A47K 10/405 |
| 10,952,569 | B2 * | 3/2021 | Grosz, Jr. | A47K 10/3836 |
| 11,299,361 | B2 * | 4/2022 | Mainville | B65H 16/023 |
| 2004/0084559 | A1 * | 5/2004 | Fraser | B65H 23/063 242/422.4 |
| 2006/0217820 | A1 | 9/2006 | Holt et al. | |
| 2006/0284001 | A1 | 12/2006 | Paradise et al. | |
| 2007/0040059 | A1 | 2/2007 | Kamenstein et al. | |
| 2007/0290094 | A1 * | 12/2007 | Anderson | A47K 10/3836 242/594 |
| 2016/0037979 | A1 * | 2/2016 | Mattheeussen | A47K 10/38 242/422.1 |
| 2020/0102180 | A1 * | 4/2020 | Robertson | B65H 75/12 |

FOREIGN PATENT DOCUMENTS

| | | | |
|---|---|---|---|
| CN | 106455873 | A | 2/2017 |
| EA | 027926 | B1 | 9/2017 |
| RU | 2139234 | C1 | 10/1999 |
| RU | 2416567 | C2 | 4/2011 |

OTHER PUBLICATIONS

National Intellectual Property Administration (CNIPA) of the People's Republic of China, First Office Action, Application No. 201880094468.8, dated Sep. 18, 2021 (18 pages).
European Patent Office, International Search Report and Written Opinion of the International Searching Authority, International Application No. PCT/EP2018/065540, dated Jan. 29, 2019 (10 pages).
European Patent Office, Written Opinion of the International Preliminary Examining Authority, International Application No. PCT/EP2018/065540, dated Apr. 7, 2020 (7 pages).
European Patent Office, International Preliminary Report On Patentability, International Application No. PCT/EP2018/065540, dated Oct. 15, 2020 (16 pages).
Canadian Intellectual Property Office; Examination Search Report; dated Feb. 2, 2022; Application No. 3,102,304; Filed: Nov. 30, 2020; 3 pages.

* cited by examiner

SUPPORT SPINDLE ASSEMBLY FOR A ROLL

CROSS REFERENCE TO RELATED APPLICATION

The present application is a U.S. National Stage entry under 35 U.S.C. § 371 of, and claims priority to, International Application No. PCT/EP2018/065540, filed Jun. 12, 2018, the disclosure of which is hereby incorporated herein by reference in its entirety.

FIELD OF THE INVENTION

The invention relates to a support spindle assembly for rotatably supporting a coreless paper roll for dispensing.

BACKGROUND OF THE INVENTION

Dispensing from a cored or coreless paper roll without a rotational brake mechanism may result in overspinning of the roll, i.e., the roll spinning freely and the user withdrawing more paper than intended. Such free rotational dispensing leads to paper waste, which is costly and not environmentally friendly. Overspinning may also result in the leading tail of the paper ending up inside the dispenser, and thereby not being readily accessible to the next user.

Solutions have been proposed that utilize a tab that engages a roll of paper during dispensing. A problem with this assembly, however, is the fact that the braking force is entirely dependent on friction between the spindle member and the center of the coreless roll, which makes it difficult to anticipate or control the braking force exerted on to the roll.

Hence, there is a need for a support spindle assembly that allows the exertion of a controlled, predictable braking force and which prevents free-wheeling of a coreless roll mounted on a rotatable spindle member.

SUMMARY OF THE INVENTION

In one embodiment, a support spindle assembly is provided for rotatably supporting a coreless paper roll for dispensing. The support spindle assembly comprises a spindle base and a spindle element having a central longitudinal axis and comprising a first and a second end. The spindle element is attached to the spindle base at the first end and is rotationally fixed in relation to the spindle base. A rotatable sleeve is rotatably disposed about the spindle element and is rotatable in relation to the spindle base and to the spindle element. The support spindle assembly further comprises a resilient member disposed about the first end of the spindle element, which resilient member is arranged to cooperate with the spindle base and with the rotatable sleeve in order to provide the rotatable sleeve with rotational resistance.

The rotatable sleeve is intended to be inserted into a central cavity of a coreless paper roll and to rotatably support the coreless paper roll during dispensing. The rotatable sleeve is intended to receive the spindle element attached to the spindle base, which spindle base is arranged to be fitted in a dispenser housing or be an integral part of a dispenser housing. The resilient member is arranged between the spindle base and the rotatable sleeve in order to cooperate with both components. The resilient member exerts an axial force directly or indirectly on the rotatable sleeve, which gives rise to rotational resistance caused by friction. This resistance prevents free-wheeling, i.e., overspinning, of the coreless paper roll during unwinding.

The rotatable sleeve is provided with an outer peripheral surface for frictional engagement with a peripheral side surface of a radially inner wound portion of tissue web making up a coreless tissue roll.

The rotatable sleeve comprises a body which is axially elongated in the direction of the central longitudinal axis of the spindle element. The rotatable sleeve comprises a first end located adjacent the spindle base and second end located remote from the spindle base. The first end of said rotatable sleeve comprises an enlarged part having a radius larger than the radius of a major portion of the body of the rotatable sleeve extending towards the second end. The resilient member is arranged to directly or indirectly cooperate with a suitable facing surface on the enlarged part. Hence, the resilient member can either be in direct contact with the rotatable sleeve, in which case it is fixed against rotation, or be in contact with an intermediate component that contacts the rotatable sleeve.

The first end of the rotatable sleeve may be widening such that the enlarged part is at least partially frustoconical or partially spherical. The first end may also be provided with an annular enlarged part comprising a substantially radially extending flange, which flange can have a cylindrical or conical extension extending towards the spindle base to at least partially enclose the resilient member. The enlarged part can extend over the resilient member so that the resilient member directly or indirectly cooperates with a surface in the interior of the enlarged part. The enlarged part can extend over the resilient means in axial direction of the central longitudinal axis. By partially or fully enclosing the resilient means, the enlarged part can hold the resilient means in position, protect the resilient means and minimize the risk of the resilient means being tampered with. The enlarged part may or may not be an integral part of the rotatable sleeve.

The spindle base can be arranged to be fitted in a dispenser housing or be an integral part of a dispenser housing.

At least one spindle base holding a support spindle assembly can be fitted in a dispenser via guide channels in a dispenser so as to be slidable in those guide channels. The guide channels can be positioned in the back or rear wall of the dispenser or be positioned in either one of the side walls of the dispenser. The spindle base can also be removably fixed to the dispenser housing or an integral part of a dispenser housing. Alternatively, at least two spindle bases holding support spindle assemblies can be fitted on or be integral with a support arranged to hold two or more rolls in a multi-roll dispenser. A support comprising at least two spindle bases holding support spindle assemblies can be provided with a second support facing the first support. The second support can be mounted in or be an integral part of the dispenser, or be attached to the spindle elements on the first support to form a unit. A unit of this type can be rotated in the dispenser to present a new roll to a user. The spindle element can thereby be either movable or fixed in respect to a dispenser housing.

The rotatable sleeve may be removably mounted about the spindle element. The rotatable sleeve is mounted by displacing it along the spindle element towards the spindle base. The resilient member will be compressed as the rotatable sleeve approaches its operational position. The first end of the rotatable sleeve compresses the resilient means between the enlarged part and the spindle base upon receiving the spindle means, thereby causing a predetermined preloading of the resilient means. The resilient means will then cause a friction force in order to exert a braking force on the rotatable sleeve.

In one example, the rotatable sleeve may not be removed from the spindle element once it has received the spindle element. The second end of the spindle element and the second end of the rotatable sleeve can both be tapered. In this way, the tapered second end of the rotatable sleeve can pinch around the first end of the spindle element. The second end of the spindle element may be provided with a head and a radial flange at its outer end, which flange is spaced a predetermined distance from the head at the second end. The spindle element body is tapered towards the second end, so that the second end has a diameter that is smaller than the diameter of the elongated body of the spindle element adjacent the first end. The head and the radial flange both have diameters larger than the diameter of the elongated body adjacent the second end of the spindle element. The tapered second end of the rotatable sleeve comprises a pair of resilient tongues separated by axially extending cut-outs in the tapered second end of the rotatable sleeve. During assembly, the rotatable sleeve is arranged to be pushed onto the spindle element, with the head and the radial flange being arranged to expand and pass through the resilient tongues at the second end of the rotatable sleeve. The expanded resilient tongues will then snap back into position behind the radial flange. The rotatable sleeve will then be held in a desired axial position by the resilient member forcing the second end of the rotatable sleeve into contact with the radial flange on the spindle element.

According to one example, a first end of the resilient means is arranged to abut the spindle base, i.e., the resilient means is in contact with the spindle base but is not attached or fixed to said spindle base. The spindle base can be provided with a circular or annual slit or groove which can accommodate the first end of the resilient member in order to keep it in position.

According to a further example, the support spindle assembly further comprises an intermediate component, such as a bushing, positioned between the resilient means and the enlarged part of the rotatable sleeve. The bushing can be disposed about the spindle element. A second end of the resilient means can be arranged to abut the bushing and the bushing is in contact with at least a portion of the enlarged part of the rotatable sleeve in the axial direction of the assembly. The bushing is arranged so as to press against a corresponding surface of the enlarged part the rotatable sleeve in the direction of the central longitudinal axis.

The enlarged part of the rotatable sleeve can be provided with a suitable friction surface, such as an annular rib, on its interior, radially extending surface facing the bushing, wherein the bushing abuts the friction surface. The radially extending surface can be a radial surface or a conical surface extending in the radial direction. This allows the contact surface between the bushing and the rotatable sleeve to be dimensioned to provide a predetermined surface that, in combination with a resilient member having a predetermined spring rate, will give a desired braking force for the size and type of roll to be dispensed.

The rotatable sleeve can be made of a suitable plastic material. Non-limiting examples of suitable materials for the sleeve comprise thermoplastic polymers, such as polyamide (PA), acrylonitrile butadiene styrene (ABS), polypropylene (PP), polyethylene (PE), polycarbonate (PC), or the like, that provide sufficient strength and is suitable for injection molding. The bushing can be made of any suitable plastic material that facilitates controlled friction between contacting surfaces of the bushing and the rotatable sleeve. One non-limiting example of a suitable material for the bushing is acetal (POM).

The bushing is arranged to press against the enlarged part of the rotatable sleeve in the axial direction and thereby cause friction between the bushing and the enlarged part in order to prevent overspinning of the rotatable sleeve in relation to the spindle element. The resilient means thereby facilitates braking of the rotatable sleeve supporting a coreless paper roll during dispensing and prevents excessive lengths of paper from being dispensed.

In one example, the first end of the resilient member is attached to the spindle base, instead of merely abutting the spindle base as described above. Attaching the resilient means to the spindle base advantageously reduces the likelihood of the resilient means twisting during rotation of the rotatable sleeve when paper from the coreless paper roll is being dispensed. This avoids twisting, or winding-up, of the resilient means during dispensing, which would otherwise result in the resilient means untwisting once dispensing is complete and the leading tail of a subsequent portion of the roll retracting into the dispenser under the action of the spring.

The bushing can have an annular shape where a radially inner portion can bear against the spindle base or the spindle element. The radially inner portion can be at least partially cylindrical and ensures that the bushing is maintained centered relative to the spindle base or the spindle element.

In one example, the radially inner portion of the bushing engages with the spindle base or the spindle element in the radial direction, with the bushing being locked against rotation in relation to the spindle base and the spindle element. As indicated above, the bushing can have an axially elongated, cylindrical body and a radially extending flange. At least a part of the radially inner circumferential portion of the bushing body facing the spindle base or the spindle element can be provided with one or more form-fitting elements, such as raised ribs, extending axially along the inner surface of the elongated body. Form-fitting elements such as one or more raised ribs can be arranged to engage with corresponding axially extending slits or grooves on the spindle base or the spindle element, respectively. The bushing is thereby locked against rotation and can only move in the axial direction of the spindle base and/or the spindle element under the influence of the force exerted by the resilient means.

Locking the bushing against rotation in relation to the spindle base and the spindle element gives the advantage of eliminating the risk of the resilient means twisting during rotation of the rotatable sleeve during dispensing of paper from the coreless paper roll. The reason for this is that the resilient means will be located between two component parts that do not rotate relative to each other.

The resilient member may be in the form of a compression spring. Examples of suitable compression springs include cylindrical or conical coil compression springs, which can be made from a suitably chosen metallic or plastic material. The material and the spring rate of the compression spring are selected depending on the size of the dispenser and/or the size and type of roll to be dispensed. The resilient means facilitates braking of the coreless paper roll during dispensing by means of the force being exerted on the interior surface of the enlarged part of the rotatable sleeve. In embodiments in which the resilient member is a compression spring, the rotational resistance and the drag of the rotatable sleeve depend on the spring properties, e.g., spring constant and the degree of compression of the spring.

Advantages of using a compression spring include, for example and without limitation, the fact that a relatively long compression spring with relatively low spring constant minimizes the impact of manufacturing tolerances of the support spindle assembly; the fact that a spring is relatively easy to prototype and manufacture; and the fact that wear and friction surfaces of the assembled assembly are independent of the spring, i.e., using a steel spring and a plastic bushing. Further, the compression spring assembles into the assembly in the line of draw of the injection molded parts, which simplifies manufacturing of the plastic components.

In one example, the second end of the support spindle can engage with a locking element when the support spindle assembly is in its operational position. Such a locking element can provide additional support for the at least one spindle element in order to relieve the load on the respective spindle base. Such a locking element can be provided on the dispenser housing, e.g., on a wall opposite the wall on which the spindle base is located. Alternatively, the support spindle assembly can comprise at least two spindle elements mounted spaced apart on a common first support and extending in the same direction. In this case, locking elements can be provided on a corresponding second support, located parallel to and facing the first support within the dispenser. In addition to providing additional support, the locking element prevents a coreless paper roll being supported for dispensing by the support spindle assembly from moving in the axial direction. In this context, a locking element can comprise means for locking or snapping onto the end of a spindle element, or means for simply contacting and supporting the end of the spindle element.

The term "axial direction" is herein defined as the direction running along the central longitudinal axis of the spindle element. The rotatable sleeve is arranged to rotate around the central longitudinal axis of the spindle element. The term "radial direction" is herein defined as the direction perpendicular to the central longitudinal axis of the spindle element.

BRIEF DESCRIPTION OF THE DRAWINGS

The present invention is illustrated by way of examples and not limited to the accompanying drawings, in which like references indicate similar elements:

FIGS. 6A-6C assembly.

DETAILED DESCRIPTION OF THE INVENTION

It is to be understood by one of ordinary skill in the art that the following is a description of example embodiments only, and is not intended as limiting the broader aspects of the present disclosure.

Figure 1:
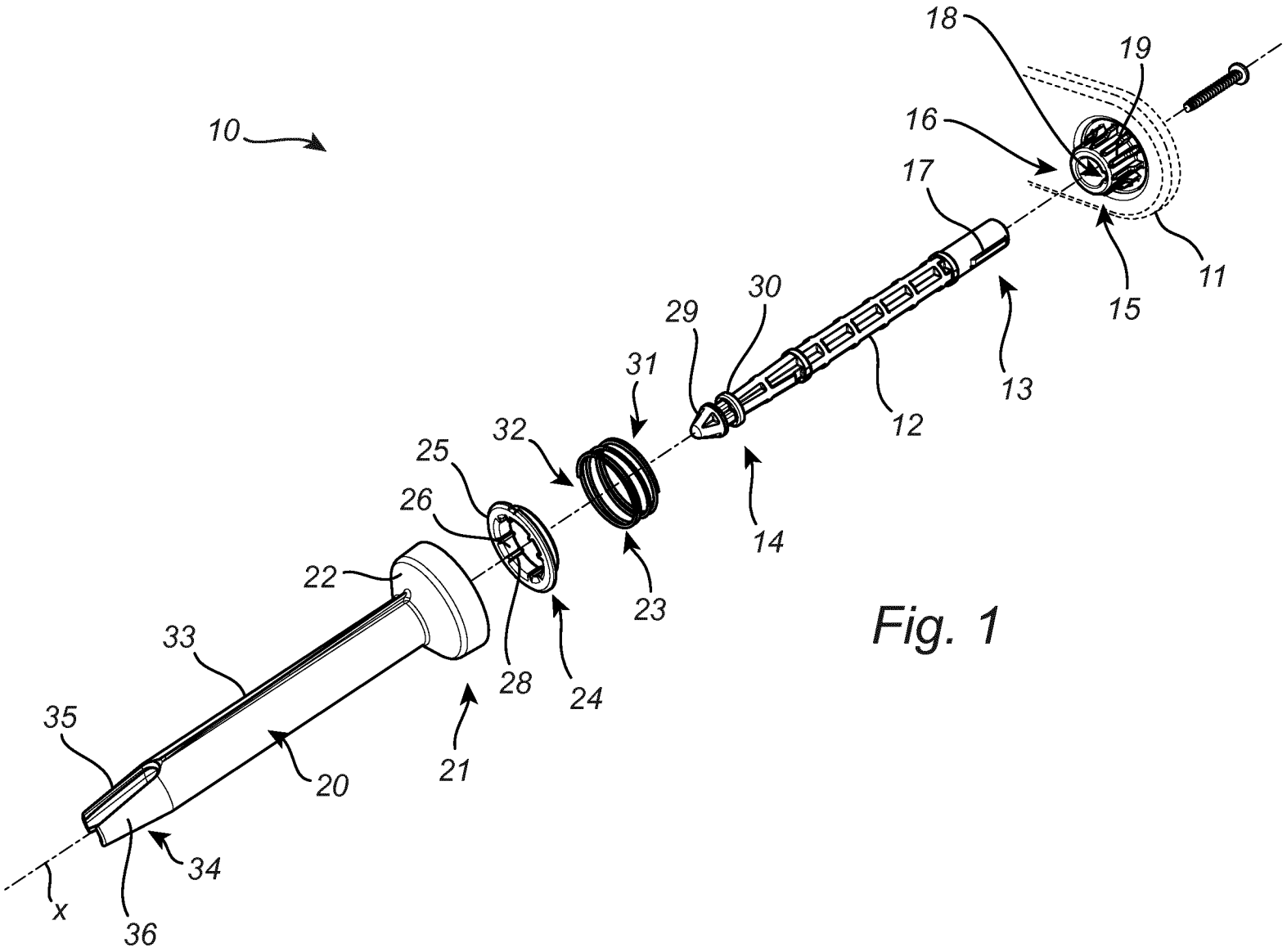
FIG. 1 is an exploded view of a support spindle assembly in accordance with an embodiment to the invention.

With reference to the figures, and particularly to FIG. 1, a support spindle assembly 10 is provided, configured for rotatably supporting a coreless paper roll for dispensing. The support spindle assembly 10 comprises a spindle base 11 and a spindle element 12 comprising a first end 13 and a second end 14. The spindle element 12 is elongated along a central longitudinal axis X and is attached to the spindle base 11 at its first end 13. The spindle base 11 has an axially extending part 15 arranged to receive the first end 13 of the spindle element 12. The first end 13 of the spindle element 12 is inserted into an opening 16 in the axially extending part 15. The first end 13 comprises a locking means 17 arranged to cooperate with a corresponding form-fitting portion 18 of an opening 16 in the spindle base 11. The spindle element 12 is thereby rotationally fixed in relation to the spindle base 11. The axially extending part 15 of the spindle base 11 is provided with axially extending grooves or slits 19 along its outer peripheral surface.

A rotatable sleeve 20, rotatable around the central longitudinal axis X, is disposed about the spindle element 12. The rotatable sleeve 20 is rotatable in relation to the spindle base 11 and the spindle element 12 attached to the spindle base 11. The rotatable sleeve 20 has a first end 21 comprising an at least partially frustoconical enlarged part 22 facing the spindle base 11.

A coiled compression spring 23 is disposed about the first end 13 of the spindle element 12. The compression spring 23 is placed over and is located by the axially extending part 15. The coiled compression spring 23, cooperating with the spindle base 11 and the rotatable sleeve 20, is arranged to provide an axial friction force and thereby act as part of a braking mechanism during dispensing of the coreless paper roll supported by the support spindle assembly 10.

A bushing 24 is disposed about the first end 13 of the spindle element 12. A flange 25 of the bushing is positioned between the compression spring 23 and the rotatable sleeve 20 in the direction of the central longitudinal axis X. The flange 25 abuts an interior surface of the frustoconical enlarged part 22 of the rotatable sleeve 20. A cylindrical part 26 of the bushing 24 is positioned onto the axially extending part 15 of the spindle base 11. The cylindrical part 26 of the bushing 24 comprises internal, axially extending ribs 28 arranged to cooperate with the axially extending grooves or slits 19 on the axially extending part 15 of the spindle base 11. This assembly prevents relative rotation between the bushing 24 and the spindle base 11, while the bushing 24 can be displaced relative to the spindle base 11 in the direction of the longitudinal axis X. A first end 31 of the compression spring 23 abuts the spindle base 11, while a second end 32 of the compression spring 23 abuts the bushing 24. Consequently, the compression spring 23 is located between two component parts that are prevented from relative rotation. The bushing 24 is thereby arranged so as to press against the frustoconical enlarged part 22 of the rotatable sleeve 20 in the axial direction under the action of the compressed spring 23, and friction is created between the bushing 24 and the rotatable sleeve 20 to brake the rotation of a roll supported on the rotatable sleeve 20. The bushing 24 allows for better control of the friction and thus better control of the rotational resistance. It also helps avoid any twisting of the compression spring 23 in its compressed state during dispensing.

As described above, the first end 13 of the spindle element 12 is attached to the spindle base 11. The second end 14 of the spindle element 12 comprises a head 29 and a radial flange 30, which flange 30 is spaced a predetermined distance from the head 29. The spindle element 12 body is tapered towards the second end 14, such that the second end 14 has a diameter that is smaller than the diameter of the elongated body of the spindle element 12 adjacent the first end 13. The head 29 and the radial flange 30 both have diameters larger than the diameter of the elongated body adjacent the second end 14 of the spindle element 12. The rotatable sleeve 20 comprises a cylindrical body 33 over a major portion of its longitudinal extension and is tapered towards its second end 34, remote from the spindle base 11. The tapered second end 34 comprises a pair of resilient tongues 35, 36 separated by axially extending cut-outs in the tapered second end 34 of the rotatable sleeve 20.

During assembly, the rotatable sleeve 20 is arranged to be pushed onto the spindle element 12, and the head 29 and the radial flange 30 are arranged to expand and pass through the resilient tongues 35, 36 at the second end 34 of the rotatable sleeve 20. At the end of the assembly, displacement of the rotatable sleeve 20 towards the spindle base 11 will cause preloading of the compression spring 23. The expanded resilient tongues 35, 36 will then snap back into position behind the radial flange 30. The rotatable sleeve 20 will then be held in a desired position by the compression spring 23 forcing the second end 34 of the rotatable sleeve 20 into contact with the radial flange 30 on the spindle element 12.

Figure 2:
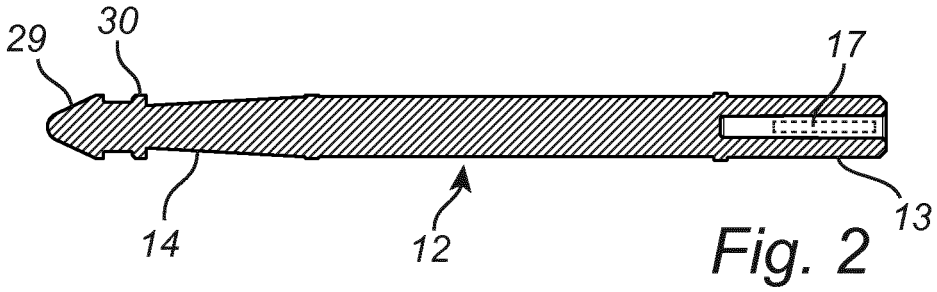
FIG. 2 is a cross sectional view of a spindle element of the assembly of FIG. 1.

With continued reference to FIG. 1, and further referring to FIG. 2, the first end 13 of the spindle element 12 is attached to the spindle base 11 (see, FIG. 1; "11"). The second end 14 comprises a head 29 and a radial flange 30. The spindle element 12 body is tapered towards the second end 14, such that the second end has a diameter that is smaller than the diameter of the first end 13 and a major portion of the elongated body of the spindle element 12.

The first end 13 comprises a locking means 17, such as a radially protruding rib, arranged to cooperate with a corresponding form-fitting portion, such as a groove, of an opening in the spindle base (see, FIG. 1) to secure the spindle element 12 against rotation. The example embodiment in FIG. 2 shows a locking means in the form of a single rib, but the locking means 17 can alternatively comprise multiple axially extending ribs, a section having a polygonal cross-section, or other similar suitable means.

Figure 3:
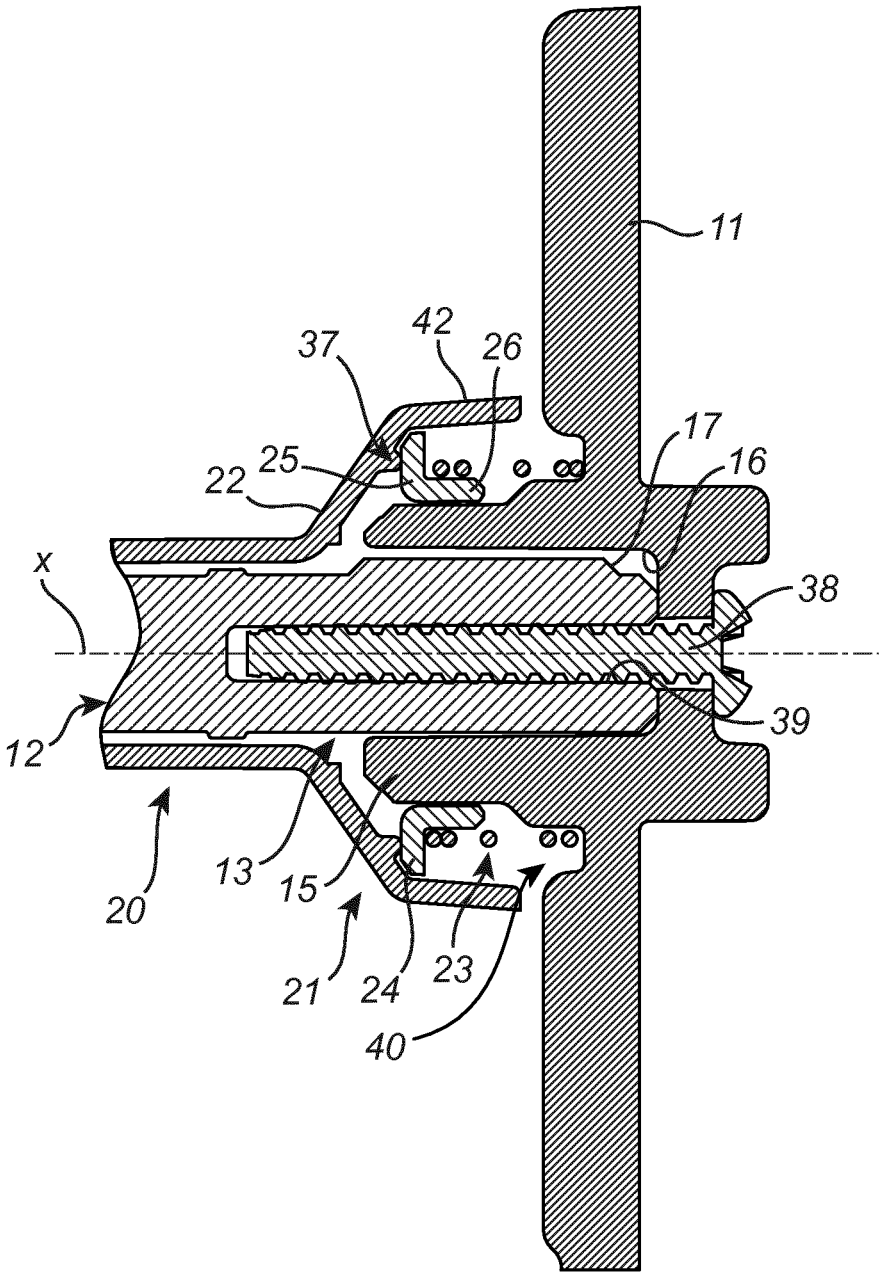
FIG. 3 is a cross-sectional view illustrating a spindle element and spindle base of the assembly of FIG. 1 attached to one another.

FIG. 3 shows the first end 13 of the spindle element 12 attached to spindle base 11 with an attachment element 38. The first end 13 of the spindle element 12 is received by a central cavity or opening 16 in an axially extending part 15 of the spindle base 11. The spindle element 12 comprises an inner threaded bore 39 elongated in the axial direction of the central longitudinal axis X. The attachment element 38, a screw in this example, engages the threads of the bore 39. The head of the screw abuts the spindle base 11. The spindle element 12 is thereby rotationally locked in relation to the spindle base 11.

Bushing 24 is disposed about the first end 13 of the spindle element 12. The bushing 24 encircles the axially extending part in the radial direction relative to the central longitudinal axis X. A radially extending flange 25 of the bushing 24 is positioned to interact with the compression spring 23 and a friction rib 37 of a rotatable sleeve 20 in the axial direction. The friction rib 37 is positioned on the interior surface of the frustoconical enlarged part 22 at the first end 21 of the rotatable sleeve 20. The shape and surface area of the friction rib 37 can be selected to provide the desired friction force between the bushing 24 and the rotatable sleeve 20. The first end 21 of the rotatable sleeve 20 opens up in the direction of the spindle base 11 and extends over and encloses the bushing 24 and at least a portion of the compression spring 23. In this example, the frustoconical enlarged part 22 can transition into a similarly shaped tapered part 42 having a steeper taper than the frustoconical enlarged part 22. The tapered part 42 encloses at least a portion of the compression spring 23. Alternatively, the frustoconical enlarged part 22 can transition into a cylindrical portion (not shown). The tapered part 42 or the cylindrical portion has a minimum internal diameter exceeding the outer diameter of the bushing 24. An annular slit 40 in the spindle base 11 locates and holds the compression spring 23 centered around the axially extending part 15 of the spindle element 12.

Figure 4:
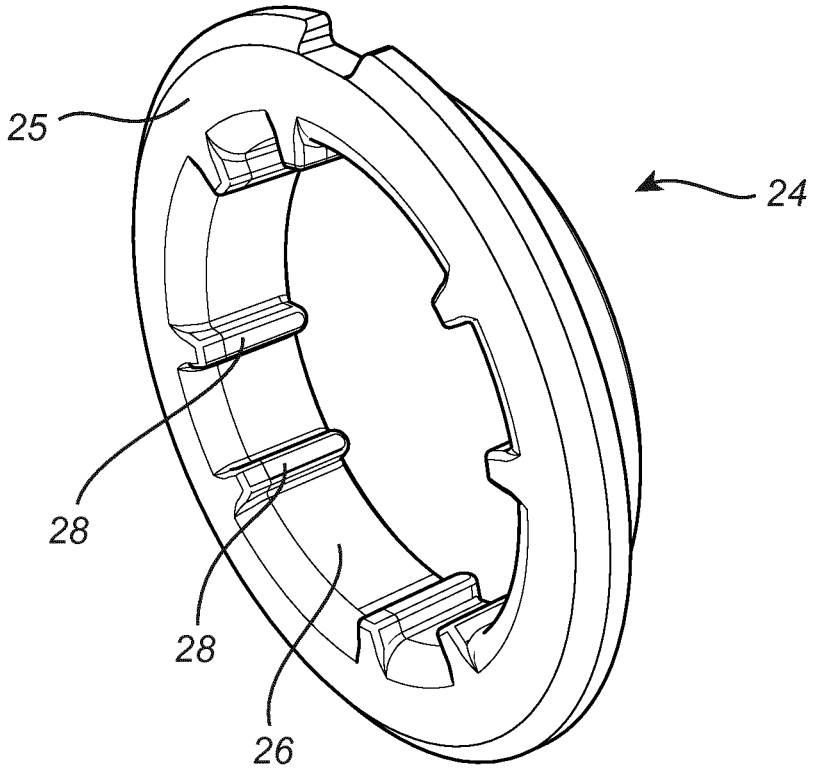
FIG. 4 is a perspective view illustrating a bushing of the assembly of FIG. 1.

FIG. 4 shows bushing 24 in further detail. Bushing 24 includes the radially extending flange 25 and cylindrical body 26, which is—in this particular embodiment—an elongated, substantially cylindrical structure. The flange 25 is configured to abut the rotatable sleeve 20 (see, FIG. 3; "20"). An inner surface of the cylindrical body 26 is provided with raised ribs 28 extending axially along the cylindrical body 26. The raised ribs 28 engage with corresponding slits on the spindle base. Slits 19 extending axially on the peripheral surface of the spindle base 11 are shown in FIG. 1. The number and size of the cooperating ribs and grooves can vary within the scope of the present disclosure. Alternatively, axially extending ribs or grooves on the bushing can be arranged to cooperate with suitable means on the spindle element (not shown). The bushing 24 is thereby rotationally locked and can only move in the axial direction under the pressure of a resilient member such as compression spring 23.

Figure 5A:
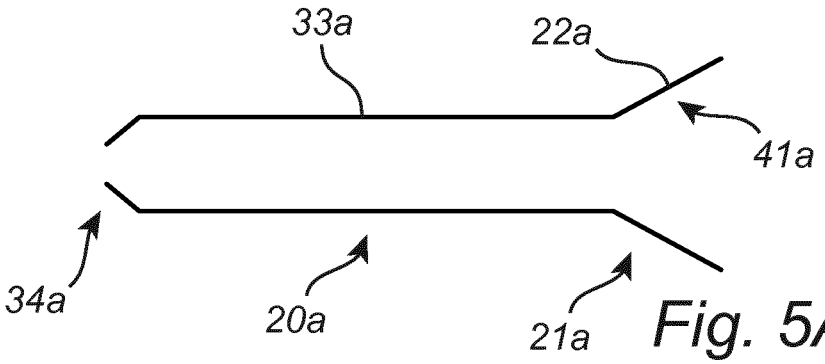
FIGS. 5A-B are schematic side views illustrating examples of rotatable sleeves attachable to the spindle element of the assembly of FIG. 1.
Figure 5B:
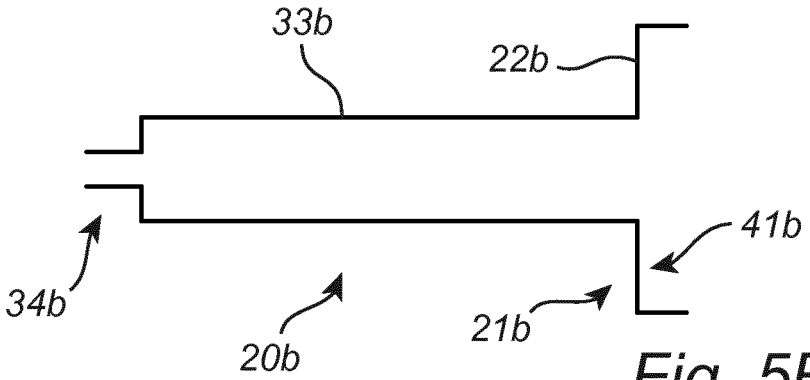

With continued reference to FIGS. 1-4, and referring now also to FIGS. 5A and 5B, and particularly to FIG. 5A, the rotatable sleeve 20*a* in the illustrated example embodiment has a first end 21*a* comprising an at least partially frustoconical enlarged part 22*a*, arranged to face the spindle base (not shown). The rotatable sleeve 20*a* comprises a cylindrical body 33*a* over a major portion of its longitudinal extension and is tapered towards its second end 34*a*, remote from the spindle base. In the example embodiment shown in FIG. 5B, the rotatable sleeve 20*b* has a first end 21*b* comprising a stepped enlarged part 22*b*, arranged to face the spindle base (not shown). The rotatable sleeve 20*b* comprises a cylindrical body 33*b* over a major portion of its longitudinal extension and has a second stepped part at its second end 34*b*, remote from the spindle base 11. In both examples (FIGS. 5A and 5B), the rotatable sleeves have a reduced diameter at their second ends, which diameters are smaller than the diameters of the major portion and the first end of the respective rotatable sleeve. The flange 25 of the bushing 24 described in FIGS. 1 and 3 can abut an outwardly extending interior surface 41*a*, 41*b* of the enlarged part at the first end of either rotatable sleeve. The embodiments shown in FIGS. 5A-5B can also be combined so that a rotatable sleeve may have one tapered end and one stepped end.

Figure 6A:
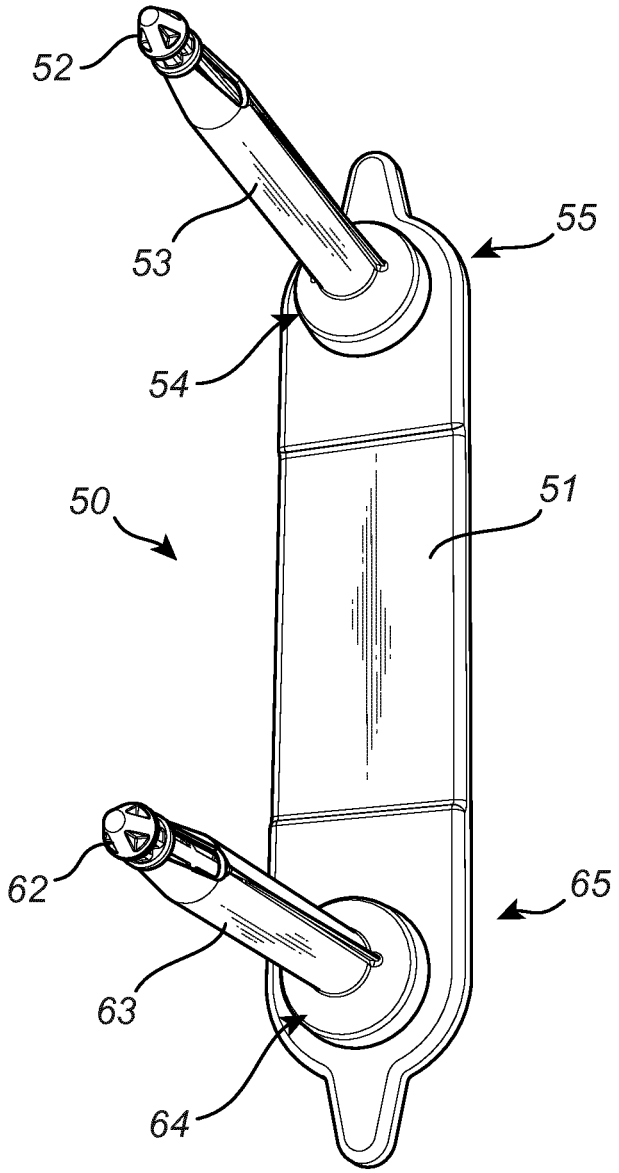
FIG. 6A is a perspective view illustrating a twin support spindle assembly in accordance with an embodiment of the invention.

FIG. 6A shows a twin support spindle assembly 50. The support spindle assembly 50 comprises a spindle support 51 comprising two spindle bases 55, 65 (see, FIGS. 1 and 3, "spindle base 15") with attached spindle elements 52, 62 and is provided with rotatable sleeves 53, 63. The spindle elements 52, 62 are fixed to their respective spindle bases 55, 65 at their first ends and are arranged to receive a roll at their second ends. The rotatable sleeves 53, 63 have a first end comprising an at least partially frustoconical enlarged part 54, 64 facing the spindle base 55, 65. The respective first ends of each rotatable sleeve 53, 63 comprise an assembly for braking the rotation of a roll supported on the respective rotatable sleeve 53, 63. This assembly is described in further detail with reference to the embodiment of FIG. 6B below.

Figure 6B:
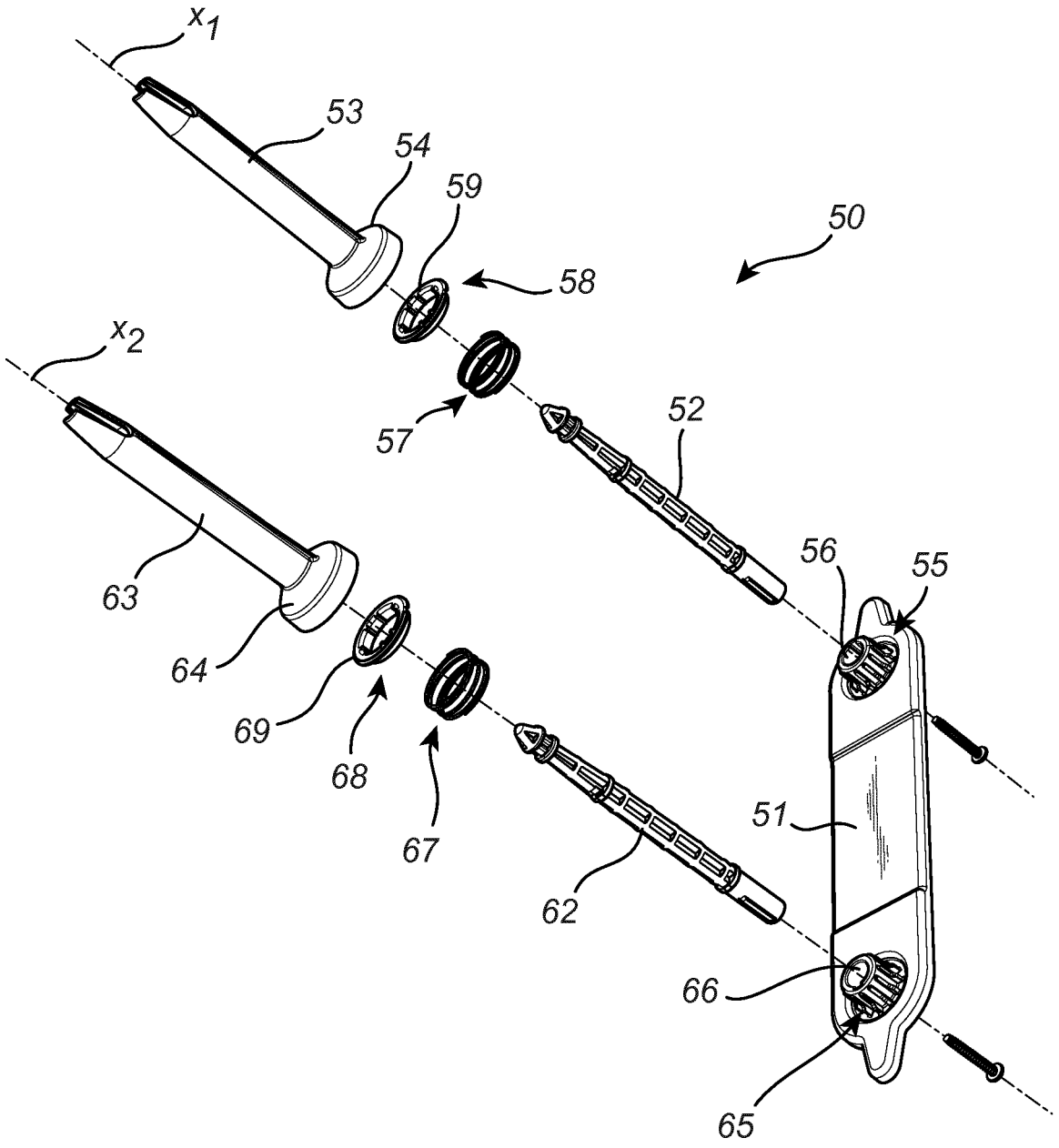
FIG. 6B is a perspective exploded view of the twin roll support spindle assembly of FIG. 6A.

FIG. 6B is an exploded view of a support spindle assembly 50 for rotatably supporting a coreless paper roll for dispensing. The support spindle assembly 50 comprises a spindle base 51 and two spindle elements 52, 62 each comprising a first end and a free second end. The spindle elements 52, 62 are elongated along a respective central longitudinal axis X1, X2 and are attached to the spindle base 51 at their first ends. The spindle base 51 comprises two axially extending parts 55, 65 arranged to receive the first ends of the respective spindle elements 52, 62. The first ends of the spindle elements 52, 62 are inserted into openings 56, 66 in the axially extending parts 55, 65. Each first end comprises a locking means arranged to cooperate with a corresponding form-fitting portion of the respective openings 56, 66 in the spindle base 51. The spindle elements 52, 62 are thereby rotationally fixed in relation to the spindle base 51. The axially extending parts 55, 65 of the spindle base 51 are provided with axially extending slits along their outer peripheral surfaces.

Rotatable sleeves 53, 63, rotatable around the central longitudinal axes $X_1$, $X_2$, are disposed about the respective spindle elements 52, 62. The rotatable sleeves 53, 63 are rotatable in relation to the spindle base 51 and the spindle elements 52, 62 attached to the spindle base 51. Each rotatable sleeve 53, 63 has a first end comprising an at least partially frustoconical enlarged part 54, 64 facing the spindle base 51.

A coiled compression spring 57, 67 is disposed about each of the first ends of the respective spindle element 52, 62. In the example shown, the compression springs 57, 67 are placed over and are located by the axially extending parts 55, 65. The coiled compression springs 57, 67 cooperate with the spindle base 51 and the rotatable sleeve 53, 63, in order to provide an axial friction force and thereby act as part of a pair of braking mechanisms during dispensing of the coreless paper rolls supported by the support spindle assembly 50.

Bushings 58, 68 are disposed about the first end of each spindle element 52, 62. A flange 59, 69 of each bushing is positioned between the respective compression spring 57, 67 and the rotatable sleeves 53, 63 in the direction of the central longitudinal axes $X_1$, $X_2$. Each flange 59, 69 abuts an interior surface of the respective conical enlarged parts 54, 64 of the rotatable sleeves 53, 63. A cylindrical part of each bushing 58, 68 is positioned onto the corresponding axially extending parts 55, 65 of the spindle base 51. The cylindrical part of each bushing 58, 68 comprises internal, axially extending ribs arranged to cooperate with the axially extending slits on the axially extending parts 55, 65 of the spindle base 51. This arrangement prevents relative rotation between the respective bushing 58, 68 and the spindle base 51, while the bushings can be displaced relative to the spindle base 51 in the direction of the longitudinal axes $X_1$, $X_2$. The first ends of the compression springs 57, 67 abut the spindle base 51, while the second ends of the compression springs 57, 67 abut the respective bushing 58, 68. In this way, the compression springs 57, 67 are each located between two component parts which are prevented from relative rotation. The bushings 58, 68 are thereby arranged so as to press against the respective frustoconical enlarged parts 54, 64 of the rotatable sleeves 53, 63 in the axial direction under the action of the compressed springs 57, 67, with friction being created between the bushings 58, 68 and the corresponding rotatable sleeves 53, 63 to brake the rotation of rolls supported on the rotatable sleeves 53, 63. The function and advantages achieved by this assembly has been described in detail in connection with the embodiments of FIGS. 1 and 3 above.

Figure 6C:
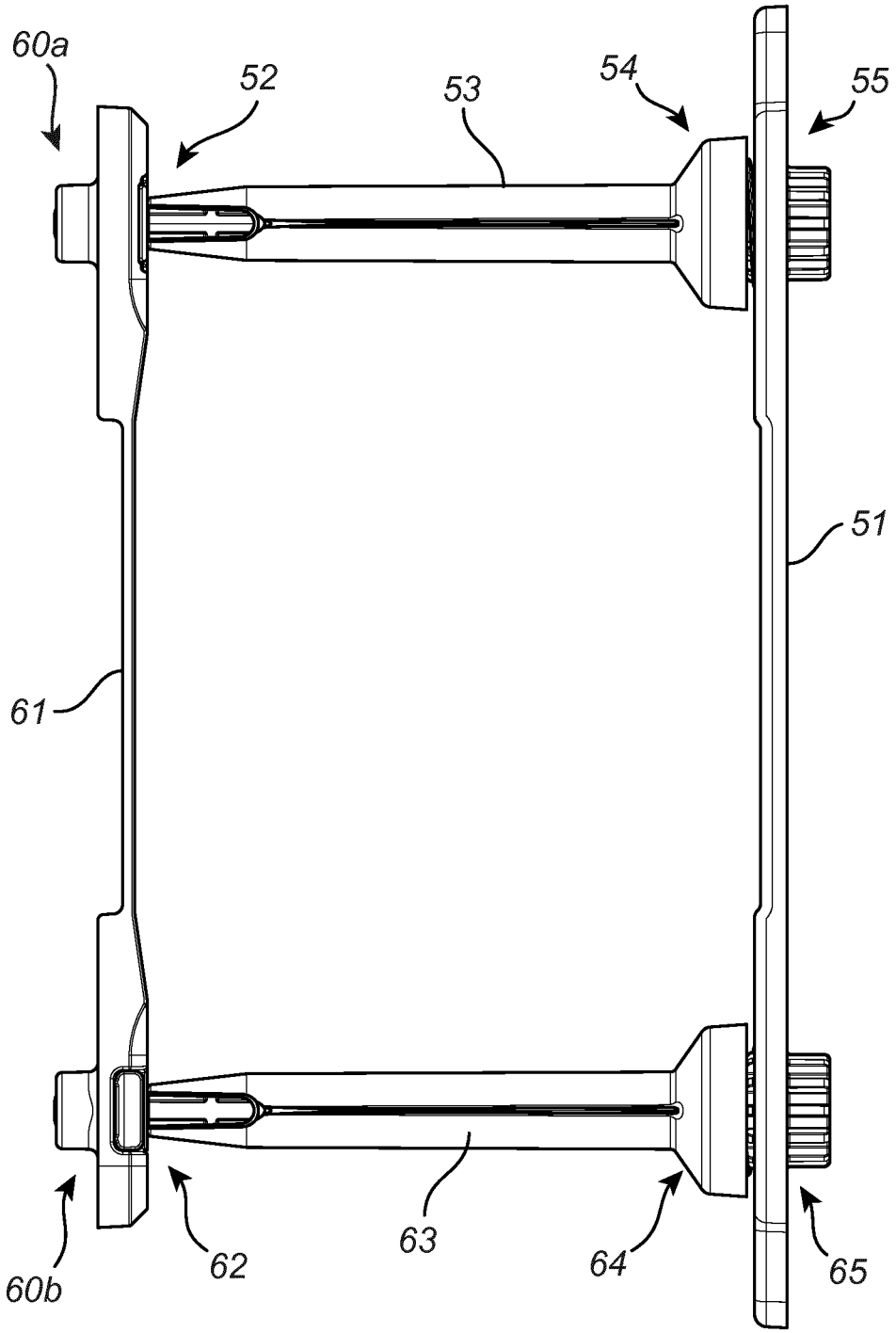
FIG. 6C is a side elevation view of the assembly of FIGS. 6A and 6B in a fully assembled state.

With reference to FIG. 6C, the first spindle support 51 shown in that figure has two spindle bases 55, 65. Spindle elements 52, 62 (see, FIG. 6B) are attached to the spindle bases 55, 65 at their first ends and each comprises a rotatable sleeve 53, 63 mounted on the respective spindle element 52, 62. The second ends of the spindle elements 52, 62 are supported by recesses 60*a*, 60*b* in a second spindle support 61 facing the first spindle support 51.

In one example, the second ends of the spindle elements 52, 62 can be inserted into and supported by the recesses 60*a*, 60*b* in a second spindle support 61. In this example, the second spindle support 61 can be mounted in or be an integral part of the housing of a dispenser on a wall opposite the wall on which the spindle base is located.

In another example, the second ends of the spindle element 52, 62 each comprises a head 29 (FIGS. 1 and 2) that can cooperate with locking elements (not shown) in the recesses 60*a*, 60*b* of the second spindle support 61 when the support spindle assembly is in its operational position. An example of suitable locking elements are resilient elements or tongues arranged to snap onto the heads of the spindle elements 52, 62 when inserted into the recesses 60*a*, 60*b*. In this example, the first and the second spindle supports 51, 61 and the connecting spindle elements 52, 62 form a unit that can be mounted in, supported by, or guided into the housing of a dispenser.

The provision of a second spindle support improves the stability of the support spindle assembly and reduces the load on the spindle elements. It will also reduce deflection of the spindle elements during dispensing. In addition to providing additional support, the locking element prevents a coreless paper roll being supported for dispensing by the support spindle assembly from moving in the axial direction.

Figure 7:
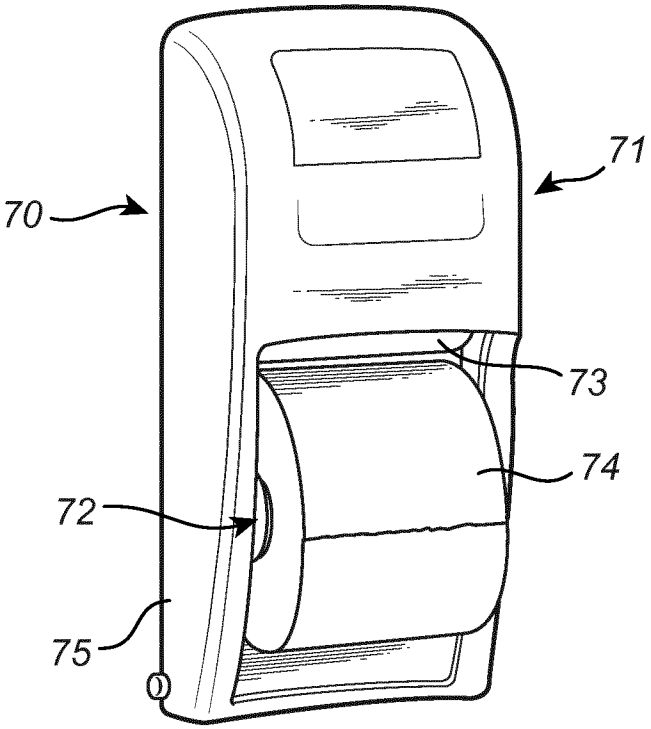
FIG. 7 is a perspective view of a dispenser that includes the twin support spindle assembly of FIGS.

FIG. 7 shows a dispenser 70 comprising a support spindle assembly of the type described above in connection with the preceding figures and variants thereof. In the example embodiment of FIG. 7, the dispenser 70 has a housing 75 enclosing a support spindle assembly comprising supports 71, 72 (one shown) for two spindle bases holding two paper rolls 73, 74. The support spindle assembly can be fitted on or be integral with the dispenser housing. In this example, the housing 75 can swing downwards to uncover the support spindle assembly attached to a rear frame (not shown) of the dispenser 70.

Figure 8:
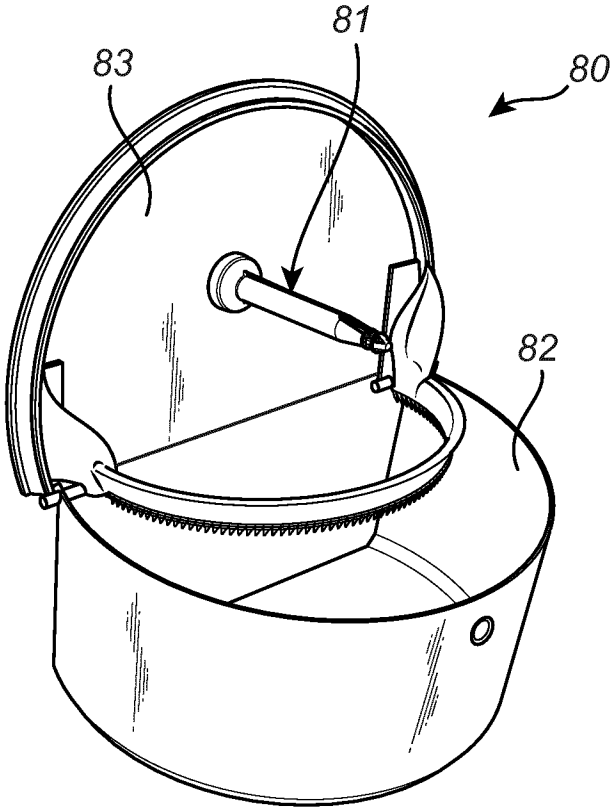
FIG. 8 is a perspective view illustrating a dispenser that includes a single-roll support spindle assembly.

FIG. 8 shows another example of a dispenser 80 comprising a support spindle assembly of the type described above. In the example of FIG. 8, dispenser 80 has a housing 82 that is shown in its open position. In its operative, closed position, the housing 82 is configured to enclose a support spindle assembly 81 comprising a spindle base, a spindle element and a rotatable sleeve (see, FIG. 1) for holding a paper roll (not shown). The support spindle assembly 81 is fitted on or integral with a wall mounted rear frame 83 of the dispenser housing 82. In the illustrated example, the housing 82 has been pivoted downwards to uncover the support spindle assembly.

The invention is not limited to the examples of coreless rolls that have been depicted in the figures. The application of the absorbent web product is broad and encompasses numerous away-from-home, domestic or sanitary applications, e.g., towels, kitchen towels, hand towels, toilet papers, wipes, facial tissues, bath tissues, napkins, etc., that are dispensable from a roll.

Any reference sign in a claim should not be construed as limiting the claim. The word "comprising" does not exclude the presence of elements other than those listed in a claim. The word "a" or "an" or "at least one" preceding an element does not exclude the presence of a plurality of such element. Thus, the present disclosure is not limited to the above examples, but various modifications and alterations are conceivable within the scope of the appended claims.

What is claimed is:

1. A support spindle assembly for rotatably supporting a coreless paper roll for dispensing, the support spindle assembly, comprising:

a spindle base;

a spindle element extending along a central longitudinal axis and having a first end and a second end, said spindle element being attached to said spindle base at said first end and rotationally fixed in relation to said spindle base;

a first rotatable sleeve rotatably disposed about said spindle element, and rotatable in relation to said spindle base and to said spindle element; and a resilient member disposed about said first end of said spindle element and configured to cooperate with said spindle base and with said first rotatable sleeve to exert an axial force directly or indirectly on the rotatable sleeve in order to provide said rotatable sleeve with rotational resistance caused by friction during unwinding.

2. The support spindle assembly according to claim 1, wherein said first rotatable sleeve includes a body that is axially elongated in the direction of the central longitudinal axis (X) of said spindle element, said first rotatable sleeve including a first end and a second end, wherein said first end of said first rotatable sleeve has an enlarged part having a radius larger than a radius of the body of said first rotatable sleeve, and wherein said resilient member is configured to cooperate directly or indirectly with said enlarged part.

3. The support spindle assembly according to claim 2, wherein said enlarged part extends over said resilient member such that said resilient member cooperates with an interior surface of said enlarged part.

4. The support spindle assembly according to claim 2, wherein said enlarged part is an integral part of said first rotatable sleeve.

5. The support spindle assembly according to claim 1, wherein said first rotatable sleeve is removably mounted about said spindle element, and said resilient member is compressed when said first rotatable sleeve is mounted about said spindle element.

6. The support spindle assembly according to claim 1, wherein said resilient member includes a first end, said first end of said resilient member abutting said spindle base.

7. The support spindle assembly according to claim 1, wherein said resilient member includes a first end, said first end of said resilient member being attached to said spindle base.

8. The support spindle assembly according to claim 1, further comprising a bushing positioned between said resilient means and said first rotatable sleeve, said resilient means including a second end abutting said bushing and said bushing being in contact with said rotatable sleeve in the axial direction and being configured to press against said first rotatable sleeve in the direction of the central longitudinal axis.

9. The support spindle assembly according to claim 8, wherein said enlarged part of said first rotatable sleeve includes a friction surface on an interior surface thereof, said friction surface facing said bushing, said bushing being in abutting engagement with said friction surface.

10. The support spindle assembly according to claim 9, wherein said friction surface is an annular friction rib.

11. The support spindle assembly according to claim 8 wherein said bushing engages said spindle base or said spindle element in the radial direction, so that said bushing is locked against rotation relative to said spindle base and said spindle element.

12. The support spindle assembly according to claim 1, wherein said resilient member is a compression spring, said compression spring being configured to be compressed and to exert a force on said first rotatable sleeve.

13. The support spindle assembly according to claim 1, wherein said second end of said support spindle is configured to engage a locking element.

14. The support spindle assembly according to claim 1, further comprising at least two spindle elements and a second rotatable sleeve, each of said first and second rotatable sleeves being rotatably disposed about a respective one of said at least two spindle elements.

15. The support spindle assembly according to claim 14, wherein said at least two spindle elements are respectively attached to the spindle base at their respective first ends and rotationally fixed in relation to said spindle base.

* * * * *